United States Patent [19]

Breuhan et al.

[11] Patent Number: 4,768,355

[45] Date of Patent: Sep. 6, 1988

[54] ACCUMULATOR WITH REFRIGERANT PROCESSING CARTRIDGE FOR AUTOMOTIVE AIR CONDITIONING SYSTEM

[75] Inventors: Ronald G. Breuhan, Farmington Hills; Jayendra J. Amin, Pontiac, both of Mich.

[73] Assignee: Ford Motor Company, Dearborn, Mich.

[21] Appl. No.: 6,839

[22] Filed: Jan. 27, 1987

[51] Int. Cl.[4] ..... F25B 43/00

[52] U.S. Cl. ..... 62/503; 62/474; 261/DIG. 6

[58] Field of Search ..... 62/503, 474, 475; 261/DIG. 6

[56] References Cited

U.S. PATENT DOCUMENTS

| | | | |
|---|---|---|---|
| 1,672,571 | 6/1928 | Leonard | 418/73 |
| 2,608,269 | 8/1952 | Briggs | 62/470 |
| 3,633,377 | 1/1972 | Quick | 62/192 |
| 3,778,984 | 12/1973 | Lawser | 55/333 |
| 4,173,440 | 11/1979 | Libis | 418/84 |
| 4,289,461 | 9/1981 | van Oorschat et al. | 418/84 |
| 4,331,001 | 5/1982 | Jones | 62/503 |
| 4,354,362 | 10/1982 | Schumacher | 62/474 |
| 4,474,035 | 10/1984 | Amin et al. | 62/503 |
| 4,509,340 | 4/1985 | Mullally et al. | 62/503 |
| 4,553,906 | 11/1985 | Boller et al. | 417/295 |

FOREIGN PATENT DOCUMENTS

| | | |
|---|---|---|
| 2720214 | 3/1977 | Fed. Rep. of Germany . |
| 3506433 | 2/1985 | Fed. Rep. of Germany . |
| 1512507 | 6/1978 | United Kingdom . |

*Primary Examiner*—Ronald C. Capossela

*Attorney, Agent, or Firm*—Jerome R. Drouillard; Roger L. May

[57] ABSTRACT

An accumulator for use in an air conditioning system for an automotive vehicle includes a cylindrical housing with an inlet tube and an outlet tube extending through the housing, and an axially insertable refrigerant processing cartridge positioned within the housing and including an outer casing, a desiccant, a filter and a separator, all for processing the refrigerant flowing through the accumulator.

13 Claims, 2 Drawing Sheets

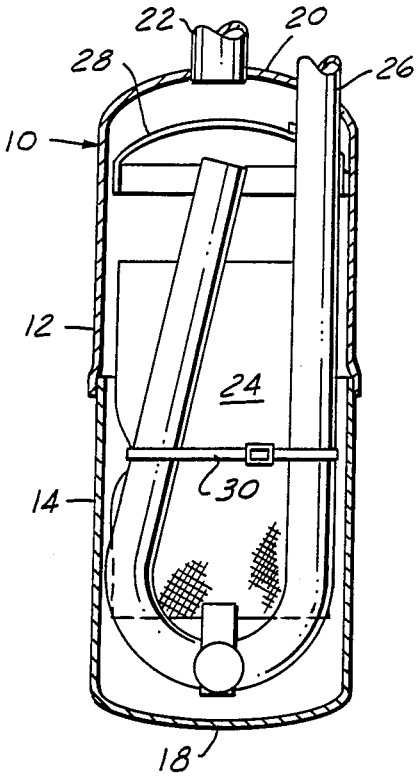
FIG. 1
PRIOR ART
FIG. 3
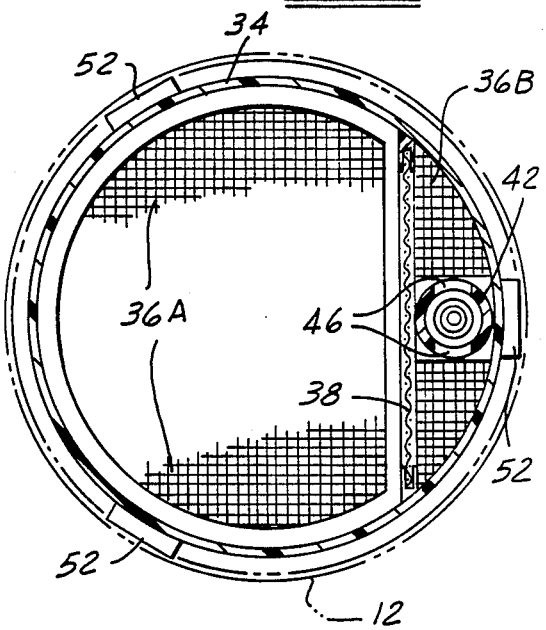
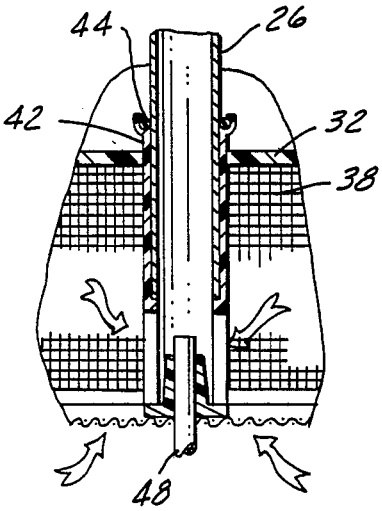
FIG. 4

ACCUMULATOR WITH REFRIGERANT PROCESSING CARTRIDGE FOR AUTOMOTIVE AIR CONDITIONING SYSTEM

BACKGROUND OF THE INVENTION

1. Field of the Invention

This invention relates to an accumulator with a refrigerant processing cartridge for an automotive air conditioning system.

2. Disclosure Information

Automotive air conditioning systems typically use Freon as a refrigerant. An air conditioning compressor in the system compresses Freon for delivery to an air conditioning condenser where the state of the refrigerant changes from gas to liquid. The outlet side of the condenser is connected to an expansion device and to an evaporator where the refrigerant changes state from a liquid to a gas. An air blower circulates air over the evaporator to the vehicle passenger compartment causing heat transfer to occur from the ambient air to the evaporator.

The outlet side of the evaporator in some air conditioning systems is connected to an accumulator that contains a liquid-gas separator. The separator causes liquid components of the refrigerant to be separated from the gaseous component before the gaseous component is returned to the compressor. The accumulator also provides for recovery of lubricating oil contained in the refrigerant gas and for returning a metered amount of lubricating oil to the inlet side of the compressor for lubrication purposes. Because the accumulator is connected to the inlet side of the compressor, the reduced absolute pressure in the accumulator causes a portion of the liquified refrigerant to return to the gaseous state, whereupon it is returned to the inlet side of the compressor. An example of a prior art air conditioning accumulator is shown in FIG. 1 of the specification and described in U.S. Pat. No. 4,474,035, which is assigned to the assignee of the present invention.

An example of an accumulator for use on the high pressure side of a refrigeration system is shown in U.S. Pat. No. 3,778,984 which is also assigned to the assignee of the present invention. Both arrangements, regardless of whether the accumulator or separator is on the inlet side of the compressor or on the high pressure or outlet side of the compressor, function to separate liquid refrigerant from gaseous refrigerant and for separating the lubricating oil from the gas.

The amount of liquid retained in the accumulator of the present invention depends upon the conditions under which the system operates. Regardless, however, of the amount of liquid retained in the accumulator, the accumulator functions to allow only vapor to be returned to the compressor together with a very small metered amount of lubricating oil.

Designers have employed a variety of schemes for arranging accumulators or oil separators for use with compressors. In the usual case, the working fluid of the system is circulated to the accumulator tank, where the vapor components are caused to rise in the tank and are drawn off through a filter. Typically, all of the vapor passing from the accumulator or separator must first pass through the filter element. The following U.S. patents generally describe such types of accumulators or separators: U.S. Pat. Nos. 1,672,571; 3,633,377; 4,173,440; 4,289,461; and 4,553,906. Further, British Pat. No. 1,512,507 and German Pat. Nos. 2,720,214 and 3,506,433 describe similar systems for separating and filtering oil from the working fluid of a compressor. Each of these devices employs a single flow path for the working fluid being returned to the compressor. This is disadvantageous inasmuch as a blockage of the single flow path will cause failure of the refrigerating system.

U.S. Pat. No. 2,608,269 describes an oil separator for a refrigeration system in which all of the gases and oil entering the oil separator must first pass through a solid adsorbent block and then through a matted mesh strainer before passing out of the separator. This type of system as well as systems described in U.S. Pat. Nos. 4,331,001 and 4,509,340 suffer from a common deficiency inasmuch as the refrigerant may be subjected to an excessively high pressure drop occasioned by the requirement of passage along a single flow path through not only a screen element but also through a desiccant or dehydrator material. The latter two patents describe automotive air conditioning accumulator assemblies in which a cartridge including a desiccant material has an outlet extending from the cartridge at a right angle to the axis of the accumulator. These cartridges are not well suited, therefore, to automated assemblies of the accumulators because the cartridges are not susceptible to axial insertion into the upper portion of the cylindrical housing of the accumulator.

It is an object of the present invention to provide an accumulator with a refrigerant processing cartridge which is axially inserted within the housing of the accumulator.

It is yet a further object of the invention to provide an accumulator with an axially insertable refrigerant cartridge including drier means for removing moisture from refrigerant, filter means for removing particulate matter from refrigerant, and separator means for promoting the separation of liquid and vapor components of the refrigerant.

It is yet a further object of the present invention to provide an accumulator with an axially insertable refrigerant processing cartridge which may be inserted by an automated assembly process.

It is yet another object of the present invention to provide an accumulator having an axially insertable refrigerant processing cartridge which may be replaced when the cartridge becomes excessively soiled or otherwise spent.

It is yet another object of the invention to provide a refrigerant processing cartridge for use in the accumulator of an air conditioning system wherein the cartridge has a dual flow path for the refrigerant in order that the refrigerant will not be subjected to an unduly great flow restriction on its way through the accumulator.

Other objects, features and advantages of the present invention will become apparent through the following description of the invention.

SUMMARY OF THE DISCLOSURE

In accordance with an embodiment of this invention, an accumulator for use in an air conditioning system for an automotive vehicle with a system including refrigerant and a refrigerant circuit having a compressor, and a condenser and an evaporator arranged in a series relationship on the high pressure side of the compressor, comprises a housing comprised of upper and lower portions joined together in abutting relationship to define a closed chamber with a central axis, with the accumulator housing having upper and lower housing walls.

An inlet tube extends through the upper wall of the accumulator and communicates with the outlet side of the evaporator. An outlet tube also extends through the upper wall of the accumulator housing and communicates with the inlet side of the compressor. The accumulator further comprises an axially insertable refrigerant processing cartridge positioned within the housing with the cartridge comprising an outer casing having upper and lower casing walls, drier means for removing moisture from the refrigerant, filter means for removing particulate matter from the refrigerant, and separator means for promoting the separation of the liquid and vapor components of the refrigerant. The cartridge is positioned within the housing by axially inserting the cartridge into the upper cylindrical portion of the housing so that the cartridge is operatively connected with the outlet tube.

The outer casing of the refrigerant processing cartridge preferably comprises a casing having a domed upper casing wall comprising a convex baffle, with the baffle comprising separator means, and means for connecting the cartridge with the outlet tube. The casing further preferably comprises a plurality of retention and locating structures extending from the casing in the vicinity of the lower casing wall. The upper and lower portions or the accumulator housing and the outer casing of the refrigerant processing cartridge are preferably cylindrical.

The means for connecting the cartridge with the outlet tube preferably comprises a port for sealingly receiving the outlet tube within the cartridge. The filter means preferably comprises a strainer extending across a lower portion of the casing and comprising the lower casing wall. The drier means preferably comprises a desiccant retained within the casing by the filtering means.

The inlet tube preferably extends through the upper wall of the accumulator housing at a location proximate the geometric center of the upper wall, and the outlet extends through the upper wall of the housing adjacent the inner wall of the housing. The particulate strainer preferably comprises first and second elements with the first strainer element positioned as the lower wall of the cartridge's outer casing, with a second strainer element positioned as an internal wall of the casing, so as to divide the first strainer element into a first section which, in combination with the second strainer element, contains desiccant material within the outer casing, so as to define a first flow path in which refrigerant will flow through both the filter and the desiccant material before flowing into the outlet tube, with the second section of the first strainer element, as determined by the internal wall, defining a second flow path permitting refrigerant to flow into the outlet tube without passing through the desiccant material.

A dual flow path refrigerant processing cartridge according to the present invention therefore comprises a casing, filter means for removing particulate matter from the refrigerant and drier means for removing moisture from the refrigerant, with the filter and drier means disposed within the casing so as to comprise a first flow path for the refrigerant in which refrigerant exiting the accumulator must pass through both the filter means and the drier means, and a second flow path in which refrigerant leaving the accumulator must pass only through the filter means. The cartridge further comprises means for aspirating lubricating oil and refrigerant droplets into the flow of refrigerant leaving the accumulator. The cartridge further preferably comprises means for positioning the cartridge within an automated assembly machine with the positioning means comprising means for indexing the cartridge within the accumulator. This means preferably comprises a plurality of locating tabs spaced about the periphery of the casing which defines the outer boundary of the cartridge.

BRIEF DESCRIPTION OF THE DRAWINGS

FIG. 1 is a cut away view of a prior art automotive air conditioning accumulator.

FIG. 3 is a cross section, partially broken away, of an accumulator according to the present invention taken along the line 3—3 of FIG. 2.

FIG. 4 is a partial cross section of an accumulator according to the present invention taken along the line 4—4 of FIG. 2.

DESCRIPTION OF THE PREFERRED EMBODIMENTS

Figure 2:
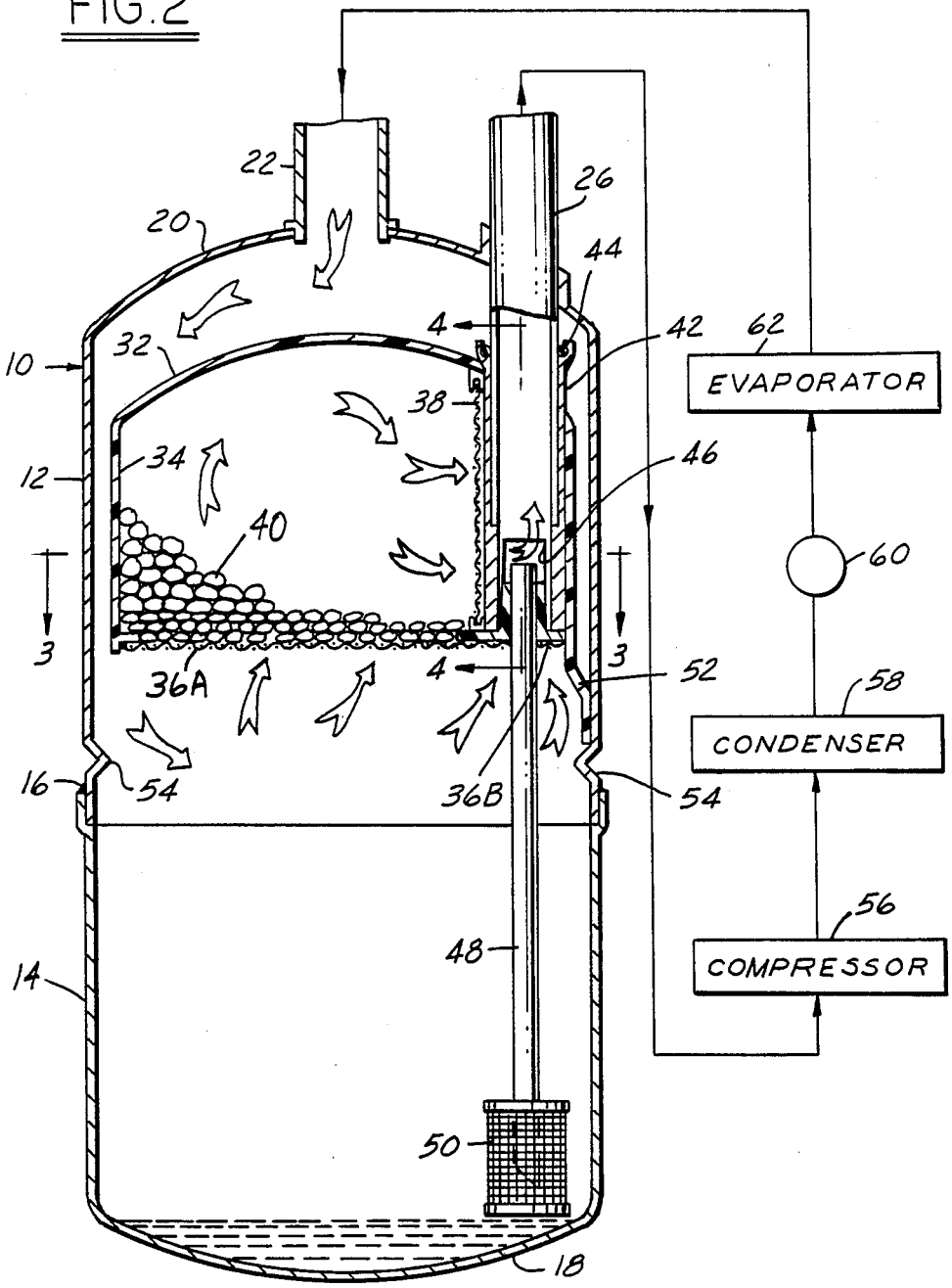
FIG. 2 is a cut away view of an accumulator according to the present invention, as well as a schematic of an air conditioning system suitable for use with an accumulator according to the present invention.

FIG. 1 shows a prior art accumulator in which cylindrical housing 10 comprising upper portion 12 having an upper housing wall 20 and lower portion 14 having lower housing wall 18 is equipped with inlet tube 22 and outlet tube 26. Domed baffle 28 is provided for the purpose of assisting the separation of the refrigerant components into the gaseous and liquid fractions. The capability for drying refrigerant is provided by desiccant bag 24 which is strapped to outlet tube 26.

The accumulator shown in FIG. 1 suffers from several deficiencies. First, the placement of desiccant bag is difficult to achieve through a manual operation because the bag must be wired in place upon the outlet tube. If this wiring operation is not performed properly, the bag may become damaged during a subsequent operation in which brazed or welded joint 16 is formed. If this should occur, the desiccant pellets will be allowed to escape from the bag and will fall to the bottom of the accumulator and become submerged in the oil and liquid refrigerant held in the accumulator. Much of the efficiency of the desiccant will thereby become lost because desiccant will not function efficiently when submerged in liquid. This deficiency is of considerable importance because failure of the compressor may be caused by the ingestion of loose dessicant. Yet another deficiency of the design shown in FIG. 1 resides in the fact that it is not suitable for automated assembly of the accumulator because of the need to wire the desiccant bag to the outlet tube as well as the need to bend the pickup tube and to braze the dome to the tube.

The accumulator designs disclosed in U.S. Pat. Nos. 4,331,001 and 4,509,340 suffer from previously described deficiencies inasmuch as neither is suitable for automated assembly of the accumulator, and further because only a single flow path is available for refirgerant passing through the accumulator.

As shown in FIG. 2, an accumulator according to the present invention includes cylindrical housing 10 having an axial centerline as shown and comprising upper portion 12 which includes upper housing wall 20, and lower portion 14 which includes lower housing wall 18. The upper and lower portions of the housing are joined by brazed joint 16. Those skilled in the art will appreciate in view of this disclosure that joint 16 could comprise a brazed or welded joint, or a threaded or bolted joint or any other type of suitable joint. In the event that it is desired to manufacture an easily rebuildable accumulator, joint 16 may comprise a threaded or bolted joint which will allow the refrigerant processing cartridge to be readily removed from the accumulator for renewal. Those skilled in the art will further appreciate in view of this disclosure that cylindrical housing 10 could be fabricated of various materials such as ferrous and nonferrous metals, plastics, composite materials, or other types of materials known to those skilled in the art. Those skilled in the art will further appreciate in view of this disclosure that the accumulator housing could have a geometrical shape other than that of a cylinder. Other shapes may be appropriate for other applications of the present invention.

As shown in FIG. 2, an accumulator according to the present invention is provided with inlet tube 22 which is joined with upper housing wall 20. Inlet tube 22 conveys refrigerant from evaporator 62 into the accumulator. Although FIG. 2 shows evaporator 62, condenser 58, expansion orifice 60 and compressor 56 of a conventional air conditioning system, those skilled in the art will appreciate in view of this disclosure that an accumulator according to the present invention may be used in other types of air conditioning systems and at other locations within such systems.

An accumulator according to the present invention may be joined with compressor 56 of the air conditioning system illustrated in FIG. 2 by means of outlet tube 26 which extends through upper housing wall 20 of the accumulator. As shown in FIGS. 2 and 4, an axially insertable refrigerant processing cartridge positioned within the housing is operatively connected with outlet tube 26.

The refrigerant processing cartridge shown within the accumulator of FIG. 2 comprises a generally cylindrical outer casing including a cylindrical casing side wall 34 and a domed upper casing wall 32 which comprises a convex baffle. The baffle functions as separator means for promoting separation of the liquid and vapor components of the refrigerant entering the accumulator through inlet tube 22.

The outer casing of the cartridge additionally includes a lower casing wall which is divided into strainer sections 36A and 36B (FIG. 3). Each strainer section functions as a filter to remove particulate material from the flowing refrigerant. In combination, strainer sections 36A and 36B comprise a first strainer element extending across substantially the entire lower portion of the casing. Strainer section 36A comprises a portion of a first flow path through which refrigerant flows through both the strainer and also through desiccant 40 (See FIG. 2). Strainer section 36B (FIG. 3) comprises a portion of a second flow path which permits refrigerant to flow into outlet tube 26 without first passing through desiccant material 40. In usual fashion, the desiccant material is intended to remove moisture residing in the circulating refrigerant.

As shown in FIGS. 2, 3 and 4, second strainer element 38, which comprises an internal wall of the refrigerant cartridge casing, divides the first strainer element into a first section, 36A which, in combination with second strainer element 38, contains desiccant material 40 within the outer casing of the cartridge. Thus, strainer section 36A and second strainer element 38 comprise filter means for retaining desiccant 40 within the cartridge casing. First strainer element 36A and second strainer element 38 thereby define a portion of a first flow path in which refrigerant will flow through both strainer elements and desiccant material 40 before flowing into apertures 46 in coupling tube 42 prior to leaving the accumulator through outlet tube 26. According to this first flow path, refrigerant impinging upon the domed upper casing wall 32 is separated into gaseous and liquid fractions and then flows up through section 36A of the first strainer element, and then through or over desiccant pellets 40. Flow continues through second strainer element 38, through apertures 46 within coupling tube 42 mounted within the refrigerant cartridge, and then into outlet tube 26.

As previously noted, a second refrigerant flow path is partially defined by strainer section 36B, which permits refrigerant to flow into apertures 46 in coupling tube 42 and then into outlet tube 26 without passing through desiccant material 40. Accordingly, because the refrigerant is not caused to flow through the desiccant material, the flow of refrigerant will not be hampered even in the event that the desiccant material becomes blocked to flow due to contamination. This fact is important because the performance of the air conditioning system will be maintained for a longer period of time even with a contaminated system. Another advantage of the dual flow path system resides in the fact that operation of the system with little or no refrigerant flow will likely cause damage to the compressor; this possibillity is limited by a refrigerant processing cartridge according to the present invention.

The details of coupling tube 42 and outlet tube 26 are shown in FIGS. 2, 3 and 4. Particularly with reference to FIG. 4, coupling tube 42 is shown as being mounted within the cartridge and extending from upper casing wall 32. Coupling tube 42 is equipped with O-ring seal 44 which slidingly accepts outlet tube 26 during the accumulator assembly. Accordingly, coupling tube 42 and O-ring seal 44 comprise a port for sealingly receiving outlet tube 26 within the refrigerant processing cartridge. In a broader sense, coupling tube 42 and O-ring seal 44 comprise means for connecting the refrigerant processing cartridge with outlet tube 26. As previously noted, FIGS. 2, 3, and 5 also show apertures 46 in coupling tube 42, which allow refrigerant to pass into the outlet tube as part of the two defined flow paths.

Those skilled in the art will appreciate in view of this disclosure that the desiccant contained within a refrigerant processing cartridge according to the present invention could comprise either a pellet or a porous cake form of desiccant, or any other type of desiccant suitable for use in a refrigerant processing cartridge.

A refrigerant processing cartridge according to the present invention is axially insertable within the accumulator described herein because the cartridge may be slidably engaged with outlet tube 26 and movement of the cartridge into the accumulator is guided by a plurality of retention and locating structures comprising retention and locating tabs 52 extending from the casing of the refrigerant processing cartridge in the vicinity of the lower casing wall. Structures 52, which are shown in FIGS. 2 and 3, permit an accumulator according to the present invention to be assembled properly with either automated or manual production methods. Because, as shown in FIG. 3, retention and locating tabs 52 are placed asymetrically about the periphery of the lower casing wall 36A–36B, retention and locating tabs 52 may be utilized for the purpose of positioning the refrigerant processing cartridge casing within an automated assembly machine as well as ultimately within the accumulator housing itself. In effect, retention and locating tabs 52 may be employed to index the refrigerant processing cartridge casing within the automated assembly machine. Moreover, as shown in FIG. 2, retention and locating tabs 52 are also employed for the purpose of retaining refrigerant processing cartridge casing within the accumulator. As shown in FIG. 2, each of the tabs 52 rides up and over a localized embossment 54 formed within the upper portion 12 of the cylindrical housing 10. Thus, once the refrigerant processing cartridge casing has been axially engaged with outlet tube 26 and retention and locating tabs 52 have been allowed to lock in place above embossments 54, the refrigerant processing cartridge will be retained within the accumulator. The localized nature of embossments 54 allows these embossments to be employed as a further aid to the correct assembly of the present accumulator, because the assembly operator, whether man or machine, will be able to correctly index the cartridge with the accumulator housing by indexing embossments 54 with retention and locating tabs 52.

Those skilled in the art will appreciate in view of this disclosure that the outer casing of a refrigerant processing cartridge according to the present invention, including the strainer elements, could be fabricated of various materials such as ferrous or nonferrous metals, plastic materials, or various composite materials.

Lubricating oil is allowed to circulate with the refrigerant of most conventional automotive air conditioning systems. Accordingly, an accumulator according to this invention preferably includes aspirator tube 48 including aspirator tube strainer 50. Aspirator tube 48 allows droplets of liquid refrigerant and oil to be entrained into the flow of refrigerant leaving the accumulator through outlet tube 26.

Advantageously, an accumulator according to the present invention is rebuildable. Rebuilding of the accumulator could involve disassembly of cylindrical housing 10 followed by removal of the spent or contaminated refrigerant processing cartridge, followed by insertion of a new refrigerant processing cartridge.

In sum, a refrigerant processing cartridge according to the present invention will provide dual flow paths with filter means for removing particulate matter from the refrigerant. The first of said flow paths also comprises drier or desiccant means disposed within the cartridge so as to comprise a flow path in which the refrigerant exiting the accumulator must pass through both filter and drier means. In taking said second flow path, refrigerant leaving the accumulator must pass only through the filter means. This dual path aspect of the present invention is important because it has been found that prior art accumulators which require that the refrigerant leaving the accumulator flow serially through filter means and then through a desiccant sometimes impose an undesirably great pressure restriction upon the flow of the gaseous refrigerant. An accumulator according to the present invention will not subject the flowing refrigerant to unduly great flow restriction. Further, the positioning of desiccant within a cartridge elevated above the liquid within the accumulator assures that the desiccant will be more efficiently utilized, as it will not be submerged within the liquid refrigerant and lubricating oil.

The foregoing description presents the presently preferred embodiments of this invention. Alterations and modifications may occur to those skilled in the art, which alterations and modifications will come within the spirit and scope of the following claims.

We claim:

1. An accumulator for use in an air conditioning system for an automotive vehicle, said system including refrigerant and a refrigerant circuit having a compressor, and a condenser and an evaporator arranged in a series relationship on the high pressure side of the compressor, said accumulator comprising:

a housing comprised of upper and lower portions joined together in abutting relationship to define a closed chamber with a central axis, said accumulator housing having an upper housing wall and a lower housing wall;

an inlet tube extending through said upper wall, said inlet tube communicating with the outlet side of said evaporator;

an outlet tube extending through said upper wall of said housing, said outlet tube communicating with the inlet side of said compressor; and an axially insertable refrigerant processing cartridge positioned within said housing, said cartridge comprising:

an outer casing having upper and lower casing walls;

drier means for removing moisture from said refrigerant;

filter means for removing particulate matter from said refrigerant; and separator means for promoting the separation of the liquid and vapor components of said refrigerant; said cartridge being positioned within said housing by axially inserting said cartridge into said upper cylindrical portion of said housing so that said cartridge is operatively connected with said outlet tube.

2. An accumulator according to claim 1 wherein said upper and lower portions of said housing are generally cylindrical.

3. An accumulator according to claim 1 wherein said outer casing of said refrigerant processing cartridge comprises:

a generally cylindrical casing having a domed upper casing wall comprising a convex baffle, with said baffle comprising said separator means; and means for connecting said cartridge with said outlet tube.

4. An accumulator according to claim 3 wherein said casing further comprises a plurality of retention and locating structures extending from said generally cylindrical casing in the vicinity of said lower casing wall.

5. An accumulator according to claim 3 wherein said means for connecting said cartridge with said outlet tube comprises a port for sealingly receiving said outlet tube within said cartridge.

6. An accumulator according to claim 3 wherein said filter means comprises a strainer extending across a lower portion of said casing and comprising said lower casing wall.

7. An accumulator according to claim 3 wherein said drier means comprises desiccant retained within said casing by said filter means.

8. An accumulator for use in an air conditioning system for an automotive vehicle, said system including refrigerant and a refrigerant circuit having a compressor, and a condenser and an evaporator arranged in a series relationship on the high pressure side of the compressor, said accumulator comprising:

a cylindrical housing comprised of upper and lower cylindrical portions joined together in abutting relationship to define a closed cylindrical chamber with a central axis, said accumulator housing having an upper housing wall and a lower housing wall;

an inlet tube extending through said upper wall at a location proximate the geometric center of said upper wall, said inlet tube communicating with the outlet side of said evaporator;

an outlet tube extending through said upper wall of said housing adjacent the inner wall of said housing, said outlet tube communicating with the inlet side of said compressor; and an axially insertable refrigerant processing cartridge positioned within said housing, said cartridge comprising:

a generally cylindrical outer casing having a domed upper wall comprising a convex baffle maintained in close proximity to said inlet tube, and a lower wall;

a port for sealingly receiving said outlet tube within said cartridge;

desiccant material contained within said outer casing;

a particulate strainer comprising first and second elements with said first strainer element positioned as the lower wall of said casing, and said second strainer element positioned as an internal wall of said casing, thereby dividing said first strainer element into a first section which, in combination with said second strainer element, contains said desiccant material within said outer casing, and a second section which permits refrigerant to flow into said outlet tube without passing through said desiccant material; and means for retaining said casing within said upper cylindrical portion.

9. A dual flow path refrigerant processing cartridge for use in the accumulator of an air conditioning system for an automotive vehicle, said system including refrigerant and a refrigerant circuit having a compressor, and a condenser and an evaporator arranged in a series relationship on the high pressure side of the compressor, said cartridge comprising:

a casing;

filter means for removing particulate matter from said refrigerant; and drier means for removing moisture from said refrigerant, with said filter and drier means disposed within said casing so as to comprise a first flow path for said refrigerant in which refrigerant exiting said accumulator must pass through both said filter means and said drier means, and a second flow path in which refrigerant leaving said accumulator must pass only through said filter means.

10. A dual flow path refrigerant processing cartridge according to claim 9 further comprising a domed baffle for promoting separation of the liquid and vapor components of the refrigerant.

11. A dual flow path refrigerant processing cartridge according to claim 9 further comprising means for aspirating lubricating oil and refrigerant droplets into the flow of refrigerant leaving said accumulator.

12. A dual flow path refrigerant processing cartridge according to claim 9 further comprising means for positioning said cartridge within an automated assembly machine, with said means additionally comprising means for indexing said casing within said accumulator.

13. A dual flow path refrigerant processing cartridge according to claim 12 wherein said means comprises a plurality of locating tabs spaced about the outside of said casing.

* * * * *